United States Patent [19]

Amicel et al.

[11] 4,079,524

[45] Mar. 21, 1978

[54] MECHANICAL DRYING APPARATUS

[75] Inventors: Charles Gustave Amicel, Carrieres sur Seine; Michel Jules Jacquot, Beynes; Guy Marc Alfred Coince, Velizy-Villacoublay, all of France

[73] Assignee: Bertin & Cie, Plaisir, France

[21] Appl. No.: 713,986

[22] Filed: Aug. 12, 1976

[30] Foreign Application Priority Data

Aug. 18, 1975 France ..... 75 25524

[51] Int. Cl.[2] ..... F26B 13/26

[52] U.S. Cl. ..... 34/95; 34/9; 34/71

[58] Field of Search ..... 34/9, 71, 95

[56] References Cited

U.S. PATENT DOCUMENTS

| | | | |
|---|---|---|---|
| 1,083,279 | 1/1914 | Hermann | 34/95 |
| 2,209,759 | 7/1940 | Berry | 34/9 |
| 3,214,327 | 10/1965 | Wicker et al. | 34/95 |
| 3,289,316 | 12/1966 | Reitzel | 34/95 |

*Primary Examiner*—John J. Camby
*Attorney, Agent, or Firm*—A. W. Breiner

[57] ABSTRACT

Pasty materials are mechanically dried by passing them through a pressing zone established between conjugate elements for subjecting the material to be treated to the action of pressure in direct contact with the free surface of a layer of open and communicating cell foam which serves as a sponge and is supported by its surface opposite to said free surface against a wall for the application of pressure in such a manner that the spongy layer becomes impregnated in the said pressing zone with liquid previously contained in the said material to be treated. The liquid is caused to pass right through the spongy layer up to its opposite surface while filtering through the open communicating cells. It then issues from the supporting wall — which is porous to this end — so as to be finally evacuated.

18 Claims, 14 Drawing Figures

FIG.8
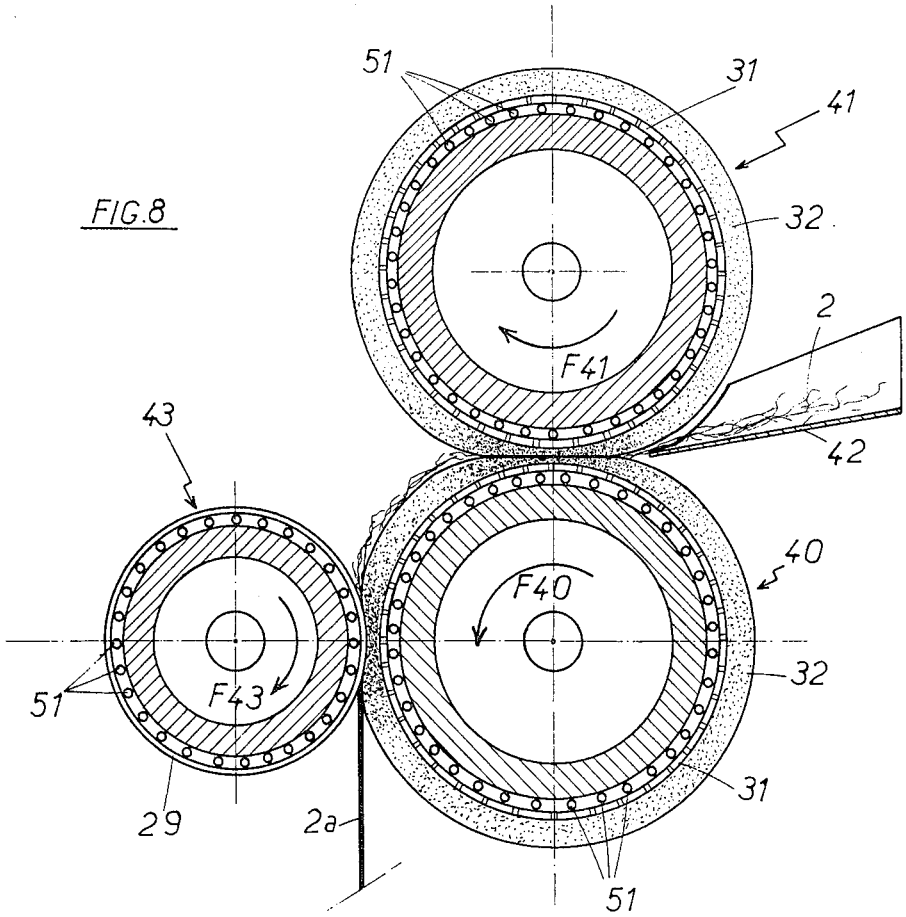
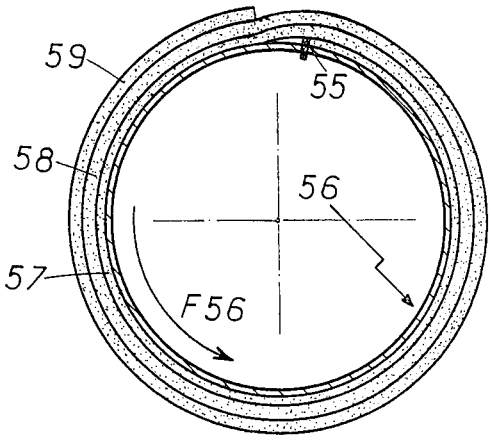
FIG.11

MECHANICAL DRYING APPARATUS

The subject of the present invention is a mechanical device for eliminating or at least considerably reducing the content of water or other liquid in pasty materials, suspensions or the like, particularly with a view to producing pastilles, the said device being preferably — but not necessarily — designed to operate continuously. More particularly, it concerns improvements applied to a known type of equipment sometimes called "a suction filter" or "a filter press" and used in various branches of industry.

Thus, in the paper industry, the machines for treating paper pulp comprise a portion called "a press section" and equipped with co-rotating adjacent rollers which between them compress an assembly composed of two passing felts and of the layer of pulp to be dried and which are constituted by a cylinder covered with rubber more or less hard and rectified, perforated with a large number of holes of a sufficiently reduced size. Moreover, the same drying principles are to be found in sludge dehydrating machines in which the sludge to be treated is continuously deposited on the upper run of an endless belt called "a band filter" passing over a driven drum and a take up drum and above which another similar endless belt called "a press band" passes at the same speed, the driven drum of which is coupled to that of the first belt, the sludge thus being subjected to considerable compression between the adjacent runs of the two belts along which are distributed pressure rollers which support the said runs so that at the outlet dehydrated sludges are obtained.

The present invention relates more specifically to the technology of mechanical drying of pasty materials, suspensions or the like, by passing them through a pressing zone established between conjugately arranged elements for subjecting the material to be treated to the action of pressing by direct contact on the free surface of a layer of open and communicating cell foam which serves as a sponge and is support by its surface opposite to the said free surface against a wall for applying pressure so that in the said pressing zone, the spongy layer becomes saturated with liquid derived from the material to be treated.

The known apparatuses which carry such a drying process into effect, only exert a very moderate pressure on the material to be treated and furthermore dry the sponge separately at a point situated beyond on the pressing zone.

On the contrary, the object of the present invention is to withdraw the extracted liquid simultaneously at a high pressure exerted by the sponge on the material to be treated.

According to the invention, it is in the pressing zone itself that the liquid, which, therein, has been derived from the material to be treated passes through the spongy layer towards the said opposite surface of the latter while filtering through the open and communicating cells then issues from the supporting wall — which to this end is porous — so as to be finally evacuated, for this reason, the liquid effecting a general migration in the same sense from the pressing zone through the spongy layer subjected to the pressing action and the supporting wall perpendicular to the latter. In other words, the process calls for a considerable compression which is accompanied simultaneously by an evacuation of the liquid through the sponge support. For this reason, the latter leaves the pressing zone quite dry and the expansion of its drying pores produces an efficient unsticking of the product compacted by the compression.

The present invention also extends to various apparatuses for carrying the process into effect and more particularly to apparatuses in which the upper porous support wall is perforated sheet metal applying the pressure without hindering the flow of liquid — which issues through it — and being capable of being reeled on a rotary drum which supports the said perforated metal sheet and in which drainage means are provided.

The drying apparatus of the invention delivers a practically dry product containing scarcely 15 to 20% humidity remaining absorbed in the granules which are thus agglomerated into quite a strong cake. That is a special advantage of the present invention which, for this reason, enables pasty products to be recovered, of for example 50% humidity, resulting from known drying treatments; however it also enables fluid products to be treated directly.

However, for the products with a very large content of water (98 to 99%), the system in accordance with the invention suffers as regards the output of dry product. Then, it is preferable to operate downstream of classic systems such as suction filters (with drums or belts), centrifugal or filter presses, which deliver products with about 75% water, the apparatus of the invention then being used to reduce the content of water to about 25%. Possible recourse to a small thermal or suction dryer downstream of the apparatus of the invention, would, if necessary, permit the total drying of the product.

The description which follows with reference to the accompanying drawings, given by way of non-limiting example, will enable the manner in which the invention may be carried out to be well understood.

FIG. 8 is a similar fragmentary view of another roller device;

FIG. 11 illustrates one advantageous arrangement of the spongy material on its roller;

Figure 1:
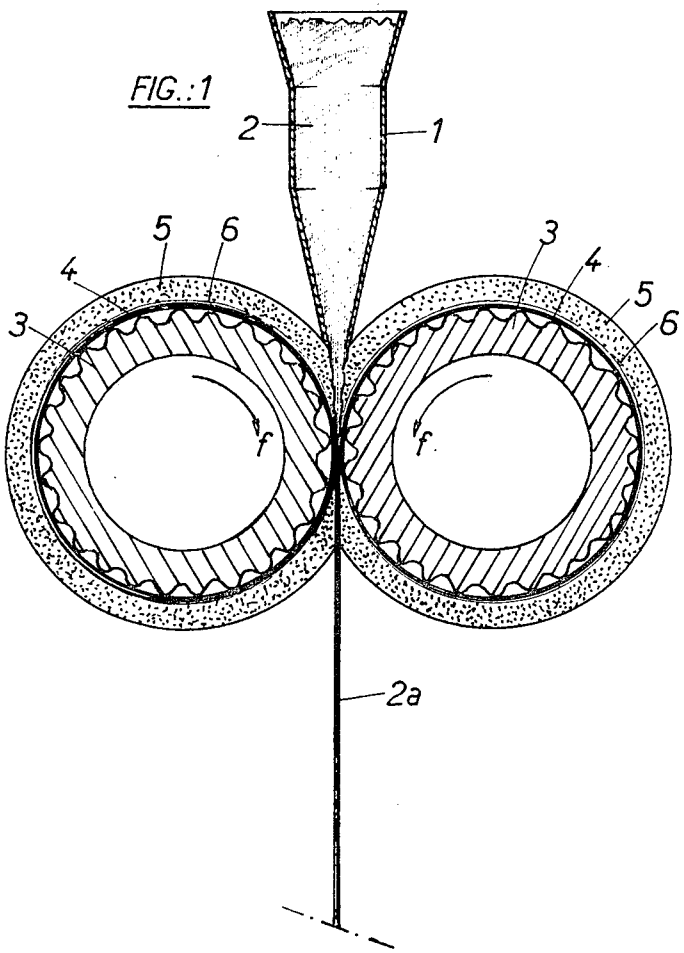
FIGS. 1 and 2 are diagrammatic views in transverse section of two embodiments of the present invention.
Figure 2:
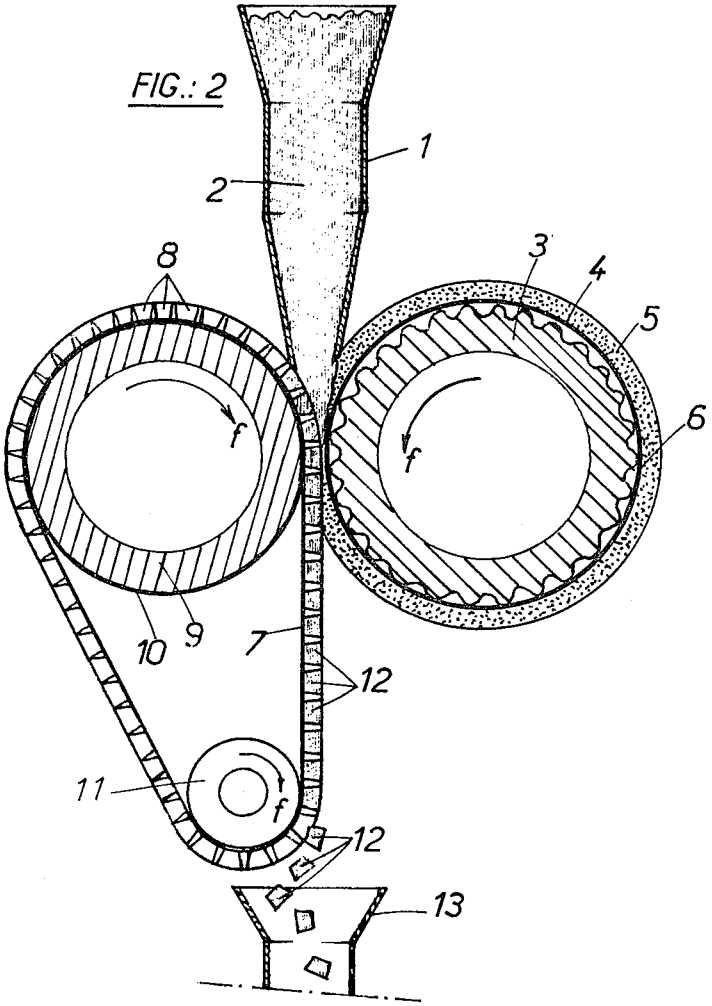

In FIGS. 1 and 2 there is shown the spout 1 for introducing the material to be treated 2 — for example a paste — which flows downwards under gravity (operation could just as well be carried out with an horizontal passage or at any other inclination, if necessary, whilst providing an adequate supply of the material with a view to a continuous feed).

Figure 4:
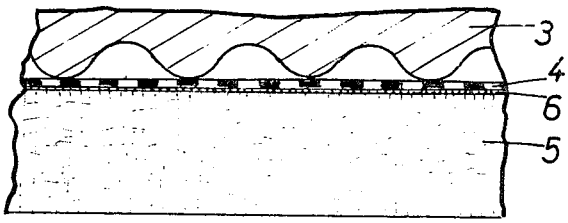
FIG. 4 is a fragmentary view in section to a larger scale show showing a detail of construction.

The apparatus in accordance with the embodiment of FIG. 1 comprises two similar conjugate rollers rotating in opposite senses as shown by the arrows *f*, at the same speed of rotation if they are of the same dimension. Each roller comprises an internally channeled drum 3 surrounding by a cylinder 4 formed from a perforated metal sheet and itself lined with a spongy layer 5 of open pore foam supported by a fine grid 6 (see also FIG. 4).

Drying of the pasty material 2 is obtained by confining it between the two sponges 5—5: the liquid extracted from the paste and impregnating the sponges is expelled by their squashing between the two perforated cylinders 4—4 and is evacuated through their perforations then by the channels in the drums 3—3. Thus, at the output from the conjugate rollers there is recovered a dried and compacted product 2*a*. It is to be noted that the sheet of paste retains substantially its dimensions under the action of the pressing force and merely increases its density.

In the variant according to FIG. 2, only a single roller has been retained with a spongy layer 5 supported as above by a perforated cylinder 4 surrounding a channeled drum 3. In this instance, the conjugate element is a perforated belt 7 having a succession of pockets for pastilles 8 and passing on the one hand around a drum 9, possibly surrounded by a metal sheet 10, on the other hand around a return drum 11 of smaller diameter. The belt 7 is driven at the same linear speed as the spongy layer 5.

This perforated belt 7 which serves as a grid for pastilles has two notable advantages:

a. retaining the material 2 within its pockets 8, it prevents it from overflowing laterally at the outlet from the spout 1 under the effect of the pressing and for this reason permits the flow of material to be dried to be increased;

b. the compacted product is moulded into pastilles 12 by the pockets 8 which have advantageously a certain taper so as to facilitate stripping which can result simply from the flexing of the belt 7 under the effects of the small radius of curvature during its passage around the return drum 11, the pastilles 12 then falling into a receiving hopper 13 (if necessary, stripping of the pastilles 12 could be ensured by pressure or suction or again by the use of a return drum 11 covered with pines engaging in the perforated belt 7).

Obtaining pastilles 12 direct from a suspension is a decided advantage since it permits the product obtained to be directly distributed, stored or accounted for.

One of the essential features of the present invention resides in drying by means of the spongy layer 5 constituted by any cellular elastomer having open and communicating cells such as rubber, flexible polyester, etc., but preferably of flexible polyurethane of about 15 to 20 mm in thickness.

During the course of drying, the sponge 5 is compressed "dead" but subsequently recovers its shape. Immediately before drying, the sponge 5 becomes saturated with the suspension 2, and which "traps" the latter and prevents it from escaping to the parts of the drier. During the course of compression, the sponge 5 is traversed by the liquid which filters through it, then through the grid 6 and the perforated metal sheet 4 to be finally evacuated by the channels in the drum 3.

The sponge 5 can be a commercial flexible plastic foam such as that used for mattresses or the upholstering of chairs.

Figure 3:
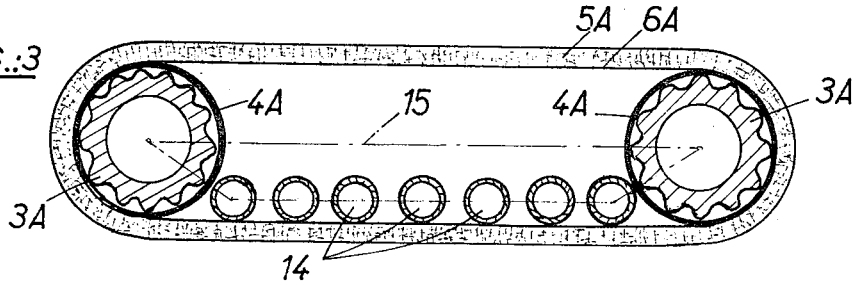
FIG. 3 is a similar partial view showing a variant of a constituent element.

The drying roller with a spongy layer of FIG. 2 or one of the two drying rollers of FIG. 1 or even both of them, may be replaced by a drying belt 5A of similar composition such as is shown in FIG. 3, passing over two drums 3A, 3A each surrounded by a perforated metal sheet 4A, the drying belt 5A being mounted on a metallic grid 6A or even a very porous fabric of wires or rot-proof cords.

The active run of the belt will be advantageously supported by auxiliary rollers 14 judicially distributed along the said active run and serving as pressure rollers. The assembly of the rotary parts may be mounted on a framework 15 represented in chain dotted lines.

The use of such a belt reduces the curvature at the commencement of drying, assuming that the counter roller (not shown) is opposite an auxiliary roller 14 or adjacent thereto. That permits a more progressive drying allowing the liquid more time to pass through the sponge 5A.

Recourse to two identical belts side-by-side at a small angle again improves this possibility.

The use of a drying belt 5A bearing against a ported drum 4A is particularly convenient for high liquid-content products (from 80 to 98%): advantage is taken thus — in a manner known per se — of a preliminary phase of filtration by gravity through belt 5A, prior to the drying phase by pressure according to the invention.

Figure 5:
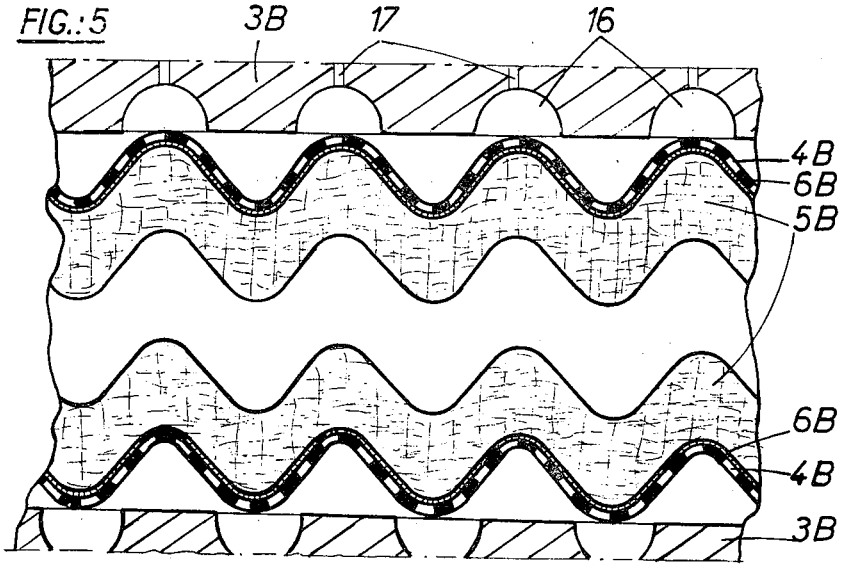
FIG. 5 is a similar view to the previous view illustrating a variant.

FIG. 5 shows the substitution in one or the other of the preceding embodiments, of an undulating spongy layer in the free state 5B, the undulation again improving the absorption of the very fluid suspension before it is dried, not only by increasing the surface of contact but by the obstacles to flow which the overlapping opposing surfaces form. The perforated metal sheet 4B (or the cylinder or the belt) may itself be undulated in this case, the thickness of the undulated spongy layer may be constant in the free state.

It will be noted moreover, that the channels in the drums 3B may be replaced by spaces or cups 16 the evacuation of which may take place through openings 17 possibly connected to a suction system.

Figure 6:
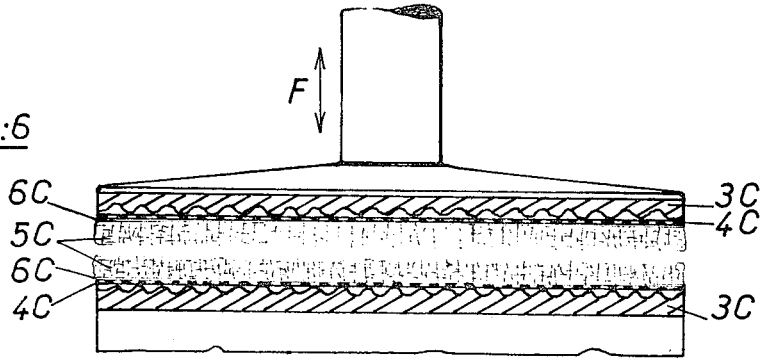
FIG. 6 is a view in section of another embodiment of the present invention.

FIG. 6 shows the use of spongy drying layers 5C—5C with fine grids 6C—6C disposed on perforated metal sheets 4C—4C on the channeled plate and channeled counter plate 3C—3C of a filter press operating discontinuously, actuated by an alternating movement according to the arrow F.

Figure 7:
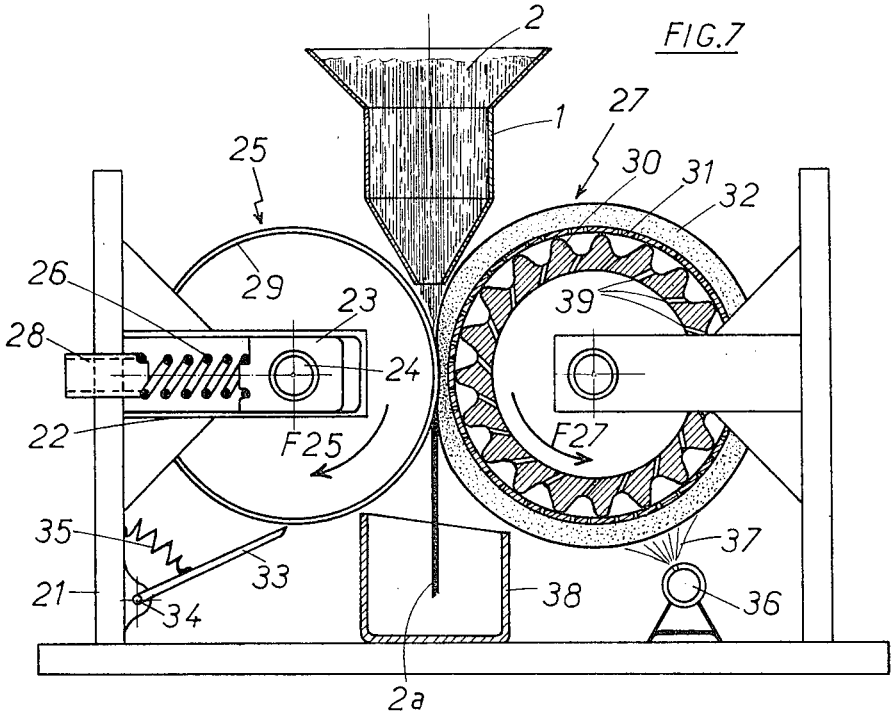
FIG. 7 is a diagrammatic view in section of a more improved embodiment in accordance with the present invention.

In FIG. 7, can be seen at 21, a structure which carries two parallel slide ways such as 22. A slide block 23 can be displaced within each of these two slide ways (horizontally in the example of the figure) and form the bearing for the shaft 24 of the roller 25 which in this instance is constituted by a plain metallic drum of smooth sheet metal 29. A spring 26, acting in compression, pushes the slide block 23 and the shaft 24 so as to cause the roller 25 to be applied against the other roller 27 which comprises a channeled drum 30, a perforated sheet metal cylinder 31 and a spongy material 32. The pressure of the roller 25 against the roller 27 can be regulated by acting upon the threaded abutment 28 of the spring 26 screwed to the structure 21.

Such an elastic suspension may be applied to the other roller 27 in the same manner as to the roller 25.

This mounting of one of the rollers or both rollers on slide ways with springs permits them to separate to allow any possible rigid bodies such as stones to pass without damaging the material, and which, if they are of an appreciable size (of the order of magnitude not greater than the distance separating the hard portions of the rollers), could otherwise cause damage by stopping the rotation of the drums, embossing the hard portions and in any case deterioration of the spongy material.

These risks can also be avoided by having, as a variant, recourse of a pneumatic roller instead of and in place of the metallic drum 25, such a pneumatic roller being for example that which forms the subject of French Pat. No. 1,529,882 of May 11, 1967. Then there is no longer any need to resort to an elastic suspension since the pressure of the rollers on one another can be regulated by acting on the inflating pressure of the pneumatic roller. Nevertheless, mounting on slide ways with springs conjointly with the regulation of the inflation pressure of the pneumatic roller, enables the pressing surface to be made to vary, the pneumatic roller being separated more or less from the counter roller 27.

It will be noted that the spongy material 32 only covers a single roller in the shape of the roller 27. In fact, it has been found that it is preferable for certain products to mount the spongy material on only one of the two rollers so as to induce the transfer of the treated products onto the smooth roller.

This arrangement of the spongy material on a single roller permits the addition of two auxiliary devices:

a scraper associated with the smooth roller 25 for cleaning its surface, a water sprinkling ramp associated with the roller 27 for cleaning the spongy material 32.

More specifically, there is provided, mounted on the structure 21, a blade 33 the end of which skims the smooth metal sheet 29 of the roller 25 at its lower part: the thus constituted scraper cleans the surface of the rotating roller 25 in the sense of the arrow F25. The blade 33 is mounted on an axis 34 and applied against the roller 25 by a tension 35. Furthermore, a ramp 36 pierced with holes and disposed near to the bottom of the roller 27, is supplied with water under pressure so as to produce jets of water 37 which clean the spongy material 32, the roller 27 rotating in the sense of the arrow F27. A similar ramp conjugate with the scraper 33 (but not shown) may complete the cleaning of the roller 25.

The treated product 2*a* is collected in a tank 38 the vertical walls of which form deflecting screens against contaminants arising out of the cleaning of the roller 25 and of the cleaning of the roller 27.

This device is particularly convenient for the drying of muds producing from iron and steel works. For rollers of 0.5 m diameter, use is made of springs 26 adjusted so that one roller engages the other with a force of 10,000 to 20,000 newtons per meter width of roller.

It is in no way imperative for the plane passing through the axes of the drying rollers to be horizontal and for the material to be treated 2 coming from the spout 1 to run vertically. Thus, FIG. 8 shows a different arrangement in which rollers 40 and 41 are mounted one above the other, the supply of the product to be dried 2 being obtained by means of an inclined channel 42.

Furthermore, a third roller 33 is provided the axis of which is in a substantially horizontal plane with respect to that of the roller 40. These three rollers rotate respectively in the senses of the arrows F40, F41 and F43, the material to be treated 2 passes first of all between the rollers 40 and 41 then between the rollers 40 and 43. The number of satellite rollers cooperating with the central roller 40 could possibly be multiplied, drying being effected in cascade in as many stages.

It is fitting to prevent the water expelled during drying from reimpregnating the treated product. That is why the rollers are in this case constituted by perforated metal sheets and the drums channeled: during the course of rotation of the rollers, the water expelled by the spongy material first of all passes through the holes in the perforated metal sheets and is trapped in the channels in the drums, then evacuated at the end of the said drums. This evacuation may be facilitated according to the invention by a slight inclination of the axis of the rollers.

In a machine comprising two rollers disposed one above the other, it is sufficient to apply the cylinder of perforated sheet metal to the lower roller whilst the upper roller is produced from plain sheet metal: the expelled water falls under gravity into the lower roller, passes through the perforated metal sheet, then is collected in the channels in the drum so as to be evacuated at the end of the latter. On the other hand, in a machine in which the rollers are disposed side-by-side with their axes at the same level, it is necessary to provide complimentary evacuation means, the water being contained within the channels situated near to the horizontal diameter and having a tendency to leave also by way of the holes themselves in the perforated metal sheets towards the treated product which becomes re-wetted thereby.

A first arrangement to this end, consists in piercing holes such as at 39 (FIG. 7) which may be radial but which are advantageously inclined in the sense of rotation F27, so as to assist drainage of the channels. The water expelled by the spongy material passes through the perforated metal sheet, arrives in the channels in the drum and flows to the interior of the latter through the holes 39; the water then falls to the lower part of the drum and by gravity repasses through the holes 39 situated at the vertical diameter so as to be evacuated laterally towards the outside. To assist this evacuation, the bore in the drum will preferably be conical (as can be seen from the left hand portion of FIG. 9); as a variation, the axis of the drums could be simply inclined.

Figure 9:
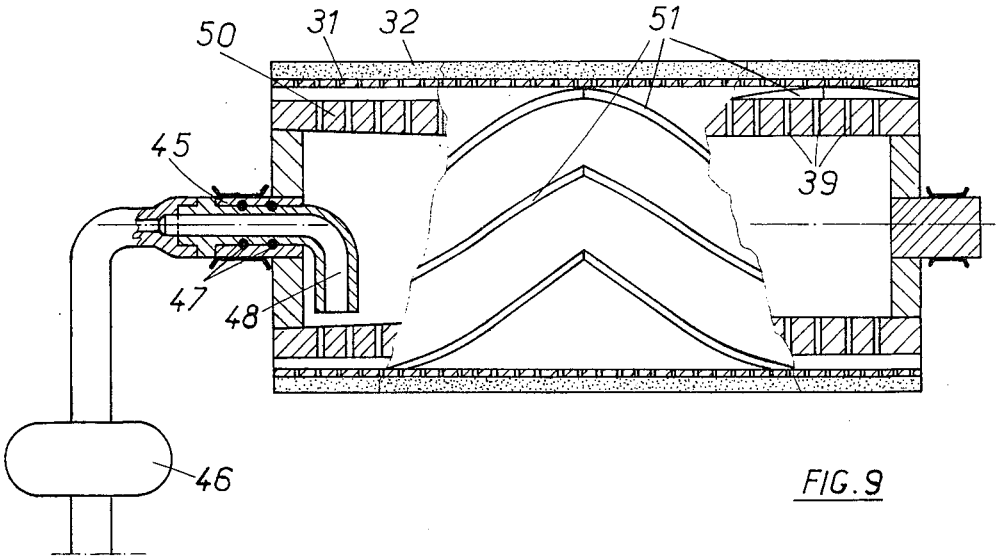
FIG. 9 shows variants in layout in section with parts removed.

A complimentary arrangement represented in FIG. 9 consists in withdrawing the water contained in the drum by suction by connecting the bottom of its space to a suction pump 46: it is sufficient to provide for the drum 50 a hollow shaft 45 in which is housed, through the agency of a rotary joint 47, a non-rotatable tube 48 connected to the suction side of the pump 46.

There is indeed represented in FIG. 9, a variant of the channels in the drum: rods or small tubes 51 (also visible in FIG. 8) preferably helical and optionally forming a series of chevrons which retain the water and channel it towards the interior of the drum 50 through the holes 59, are welded to the interior of the perforated metal sheet 31.

Figure 10:
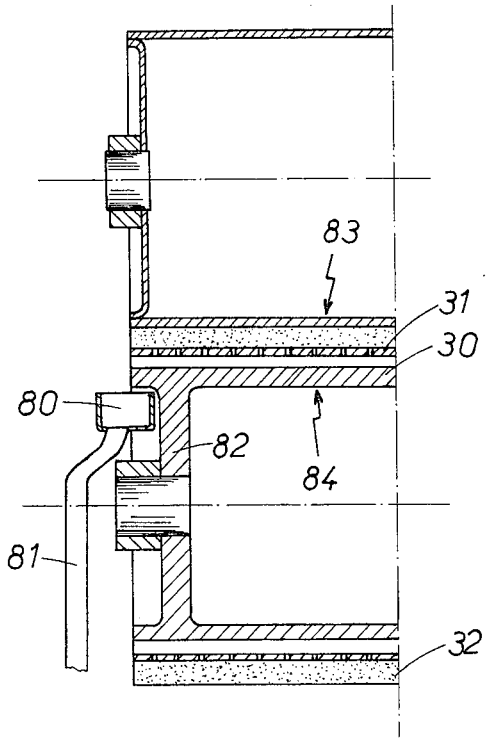
FIG. 10 is a partial view showing one method of recovering liquid arising out of the drying.

FIG. 10 shows an arrangement for recovering liquid expelled during pressing of the product between two rollers 83, 84 mounted one above the other, only the lower roller 84 being equipped with spongy material 32: the liquid passes through the holes in the perforated sheet metal cylinder 31 and flows laterally through the channels of the drum 30. This water is collected by a tank 80 which is disposed partly behind the inner surface of the rollers which is emptied by a pipeline 81. In order to permit the correct positioning of the tank 80, itself fixed by appropriate means (not shown in the drawing), the disc 82 of the channeled drum 30 is displaced towards the interior with respect to the outer surface of the said drum.

Mounting of the spongy material on the roller demands certain precautions, if the formation of folds produced by the passage of the product to be dried between the rollers is to be avoided, the spongy material being squeezed within the pressing zone and due to this, then having the tendency to elongate.

According to a technical feature of the present invention, the spongy material made from a strip the width of the roller is only fixed to one generatrix 55 of this roller 56 (FIG. 11) and it is reeled thereon in the sense opposite to its rotation F56 whilst producing turns such as 57-58-59. This arrangement allows elongation of the spongy material when it is crushed in the pressing zone so that the strip does not form folds.

Alternatively, this result may be obtained by fitting a set of partially overlapping imbricate strip segments arranged like tiles on a roof, these segments — for example of rectangular shape — being fixed at one side along equidistant generatrices of the roller, and being free at the opposite side.

However, it has been noticed that the alternation of the elongation of the spongy body during its passage between the rollers and of its contraction after the said passage creates friction of the said spongy body against the perforated metal sheets, by which wear is caused. To overcome this disadvantage, the invention provides two arrangements of composite material.

Figure 12:
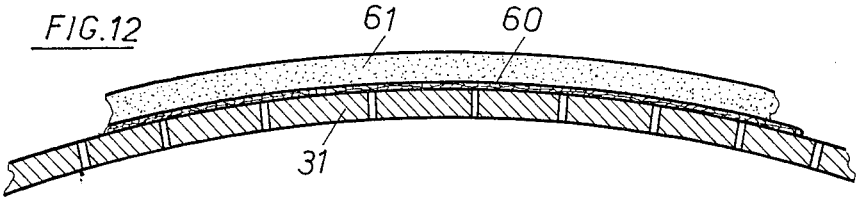
FIGS. 12 and 13 are partial views in section showing composite spongy materials.

A first arrangement consists in connecting by cross stitch, a woven porous material such as a cloth 60 (FIG. 12) with a spongy body 61, the cloth being disposed against the perforated metal sheet 31 of the roller.

Figure 13:
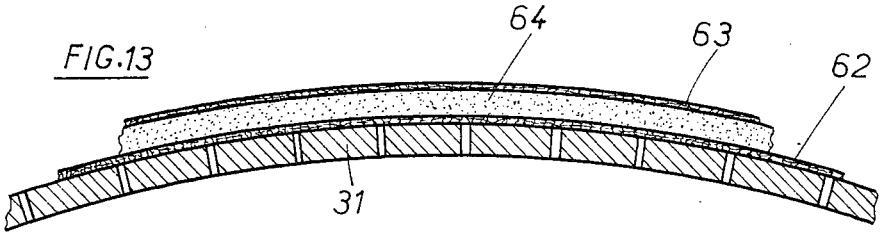

In a second arrangement (FIG. 13), two cloths 62 and 63 enclose the spongy body 64, assembly of the said sandwich always being ensured by cross stitching. The outer cloth 63 may be advantageously replaced by a skin called "chamois leather" or the like.

These two composite materials form kinds of mattresses the resistance to wear of which is increased very considerably, due to the fact that, the cloth or cloths being inextensible, elongation of the assembly cannot be produced. Thus, friction, which causes wear, against the perforated metal sheet 31 of the rollers is prevented.

Figure 14:
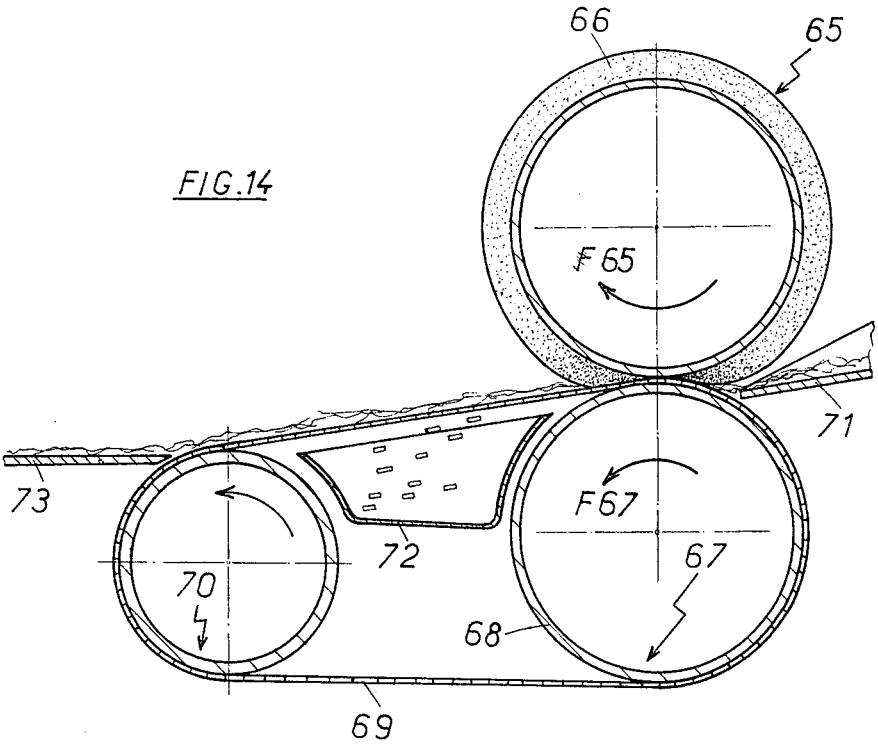
FIG. 14 is a sectional diagrammatic view illustrating one particular application of the invention.

FIG. 14 is a diagram of an apparatus adapted to materials comprising a fibrous lining which it is desired to recover. It comprises two rollers mounted one above the other. The upper roller 65 comprises a spongy material 66. The lower roller 67, comprising only a cylinder of smooth sheet metal 68, provides the movement of a flexible endless grid 69 passing around a third roller 70 mounted beside the roller 67. Feeding of a product to be treated (such as manioc for example) is produced by a shute 71, the fibre of the product being arranged towards the upper part.

The rollers 65 and 67 rotate in the senses of the arrows F65 and F67, the entire product is dried by the spongy material 66; the edible product falls through the grid 69 so as to be collected in a bin 72, whilst the fibres can pass through neither the spongy material 66 nor the grid 69; they are transported by the grid and fall under gravity as they rotate about the roller 70 or they are collected by a scraper blade 73 which skims the grid 69 at right angles to the roller 70.

A perforated belt such as 7 in FIG. 2 or a grid such as 69 in FIG. 14 provide another important advantage: when certain products are dried by pressing between two rollers, these products undergo a kind of creeping whilst spreading over a large area and whilst becoming thin to such an extent that the liquid can no longer be expelled.

On the contrary, the product divided into compartments by the pockets 8 in FIG. 2 or by the mesh of the grid 69 in FIG. 14, can no longer "creep"; it can no longer be extended in area and the liquid is therefore correctly expelled.

By way of example, some dimensions will be given hereafter of a type of apparatus comprising two drums disposed one above the other, the upper roller being smooth and the lower roller only carrying the spongy material around the cylinder of perforated sheet metal, as shown in FIG. 10.

Each roller has a diameter of 0.80 meters for a width of 0.40 meters. The thickness of the perforated metal sheet constituting the lower cylinder is of the order of 2 millimeters with holes of 2 millimeters at a pitch of 4 millimeters. The height of the interior drum channels is of the order of 6 millimeters.

The thickness of the spongy material depends on the material to be treated; this thickness may be varied between 2 and 50 millimeters.

The calibration of the springs for the slide ways supporting the rollers one against the other must be capable of producing a pressure of the order of 5 bars in the treated product pressed between the rollers.

For a linear speed of the rollers of 40 centimeters/-second, a driving motor of the order of 2 horse power is sufficient.

The examples described above refer to rollers wherein the ported sheet cylinder supporting the sponge layer is itself supported by a drum which is corrugated, channelled or lined with rods. When this cylinder is of sufficiently thick sheet, it is strong enough by itself; there is then no need to support it by a drum, and it constitutes by itself alone the drying roller.

The extracted liquid may be drained sideways by wide orifices through the discs which connect the roller to the rotation axle.

The applications of the present invention are various and numerous, but it seems that the following are of particular interest:

compacting residual sludges, recovery of precipitates (for example metallic oxides or in pharmacy), producing pastilles from all products, extraction of juices (fruit juices, beet juices, etc.), manufacture of paper and cardboard, extraction of water from the roots of manoic previously peeled and fragmented in a root slicer (which enables the length of the subsequent drying to be considerably reduced as well as the total consumption of energy), the same considerations apply to lucerns and beets.

We claim:

1. Mechanically operating apparatus for drying a pasty material, suspension or like liquid carrying substance, comprising the combination of:

a layer of compressible sponge formed of a resilient foam with open intercommunicating cells, said sponge layer having an exposed outer surface and an inner opposite thereto, a porous backing wall engaging said inner surface and bearing inwardly against at least a part of said sponge layer, a conjugate presser element positioned opposite said backing wall with respect to said sponge layer and arranged to cooperate therewith for pressingly engaging said exposed outer surface in a pressing zone of the apparatus, to positively crush said sponge layer against said backing wall in said pressing zone, said sponge layer being adapted thereafter to resume its normal shape, means for feeding said pressing zone with said liquid carrying substance, whereby liquid is extracted therefrom by soaking said open intercommunicating cells of said foam and is caused to traverse the same at the level of said pressing zone to issue from said inner surface and ooze through said porous backing wall, and means for collecting the liquid oozing from said porous backing wall and evacuating said liquid from the apparatus.

2. Apparatus as claimed in claim 1, wherein said porous backing wall comprises a ported metal sheet.

3. Apparatus as claimed in claim 1, further comprising a rigid corrugated member extending adjacent said porous backing wall and engaging the side thereof opposite to said sponge layer, whereby said porous backing wall is sandwiched between said corrugated member and said sponge layer, and the liquid oozing from said porous backing wall is collected in the corrugations of said corrugated member.

4. Apparatus as claimed in claim 3, wherein liquid draining orifices are formed at the bottom of said corrugations.

5. Apparatus as claimed in claim 3, wherein the liquid collecting in said corrugations is drained towards an end thereof, said apparatus further comprising a liquid evacuating trough cooperating with said corrugation end.

6. Apparatus as claimed in claim 1, further comprising an inextensible porous strip applied against the inner surface of said sponge layer and secured thereto, whereby said inextensible porous strip is interposed between said sponge layer and said porous backing wall.

7. Apparatus as claimed in claim 6, further comprising a further inextensible porous strip applied against the outer surface of said sponge layer and secured thereto, whereby said sponge layer is sandwiched between said inextensible porous strips.

8. Apparatus as claimed in claim 1, wherein said conjugate presser element comprises a support formed with a plurality of tablet molding recesses adapted to receive dried substance in said pressing zone.

9. Apparatus as claimed in claim 8, wherein said recesses taper inwardly to facilitate demolding of the tablets.

10. Apparatus as claimed in claim 1, wherein said sponge layer has a corrugated shape in normal state of rest.

11. Apparatus as claimed in claim 10, wherein said porous backing wall is corrugated to fit closely with said corrugated sponge layer.

12. Apparatus as claimed in claim 1, wherein said sponge layer and backing wall form an assembly constituting one component of said pressing zone, and said conjugate presser element constitutes another component of said pressing zone, said components being relatively movable with respect to each other to define said pressing zone.

13. Apparatus as claimed in claim 12, wherein said components are in the form of mutually reciprocatable plates, and define said pressing zone when moved towards each other.

14. Apparatus as claimed in claim 12, wherein at least one of said components is mounted on a roller rotatable about a shaft.

15. Apparatus as claimed in claim 14, further comprising sprung slideway means for bearing said shaft to form a resilient suspension for said roller, whereby said roller is retractable away from the other component against a resilient return force urging it towards the same.

16. Apparatus as claimed in claim 14, wherein said roller is provided with said liquid collecting means, the liquid being drained away towards an end of said roller by a slope provided thereon.

17. Apparatus as claimed in claim 16, comprising a non-rotary suction duct across said shaft for evacuating the liquid drained in said roller.

18. Apparatus as claimed in claim 14, wherein said sponge layer is fitted on said roller and comprises at least one strip of spongy material secured to said roller along only one generatrix thereof and wound around it to present a free end.

* * * * *

UNITED STATES PATENT OFFICE

CERTIFICATE OF CORRECTION

Patent No. 4,079,524 Dated March 21, 1978

Inventor(s) Charles Gustave Amicel et al

It is certified that error appears in the above-identified patent and that said Letters Patent are hereby corrected as shown below:

Column 8, claim 1, line 63, before "opposite" insert - surface -.

Column 5, line 50, "producing" should read --providing--.

Signed and Sealed this

*Nineteenth* Day of *August 1980*

{SEAL}

*Attest:*

SIDNEY A. DIAMOND

*Attesting Officer*

*Commissioner of Patents and Trademarks*